US009624773B2

(12) United States Patent
Birje et al.

(10) Patent No.: US 9,624,773 B2
(45) Date of Patent: Apr. 18, 2017

(54) PROXIMITY SWITCH ACTUATION MECHANISM

(71) Applicant: Eaton Corporation, Cleveland, OH (US)

(72) Inventors: Sandeep Manohar Birje, Pune (IN); Bilal Bhopal Said, Ann Arbor, MI (US)

(73) Assignee: EATON CORPORATION, Cleveland, OH (US)

( * ) Notice: Subject to any disclaimer, the term of this patent is extended or adjusted under 35 U.S.C. 154(b) by 586 days.

(21) Appl. No.: 13/675,570

(22) Filed: Nov. 13, 2012

(65) Prior Publication Data

US 2013/0125744 A1 May 23, 2013

Related U.S. Application Data

(60) Provisional application No. 61/561,453, filed on Nov. 18, 2011.

(51) Int. Cl.

| | |
|---|---|
| ***F15B 15/28*** | (2006.01) |
| ***F01B 25/00*** | (2006.01) |
| ***F01B 31/00*** | (2006.01) |

(52) U.S. Cl.

CPC ..... *F01B 25/00* (2013.01); *F01B 31/00* (2013.01); *F15B 15/28* (2013.01); *F15B 15/2807* (2013.01); *F15B 15/2892* (2013.01)

(58) Field of Classification Search

CPC .. F15B 15/28; F15B 15/2807; F15B 15/2815; F15B 15/2861; F15B 15/2869; F15B 15/2892; F01B 25/04; H01H 13/18

USPC ..... 91/1; 92/5 R, 61

See application file for complete search history.

(56) References Cited

U.S. PATENT DOCUMENTS

| | | | | |
|---|---|---|---|---|
| 2,918,908 | A * | 12/1959 | Herner | F15B 15/2807 200/82 R |
| 2,960,077 | A * | 11/1960 | Bosi | F15B 15/2807 74/110 |
| 3,414,693 | A * | 12/1968 | Vandenburgh et al. | 200/82 R |
| 4,207,564 | A | 6/1980 | Isakson et al. | |
| 4,632,018 | A * | 12/1986 | Lymburner | 92/5 R |
| 4,726,282 | A * | 2/1988 | LaBair | 92/5 R |
| 4,751,867 | A * | 6/1988 | Johansson et al. | 92/5 R |
| 2004/0210223 | A1* | 10/2004 | Pisharodi | A61B 17/8047 606/71 |

FOREIGN PATENT DOCUMENTS

| | | | | |
|---|---|---|---|---|
| DE | 2245399 | * | 9/1972 | F15B 15/24 |
| FR | 2377021 | * | 1/1977 | F15B 15/18 |

(Continued)

OTHER PUBLICATIONS

FR2377021 Machine Translation, espacenet.*

(Continued)

*Primary Examiner* — Michael Leslie
*Assistant Examiner* — Dustin T Nguyen

(57) ABSTRACT

An actuation mechanism for an electromagnetic switch for a hydraulic cylinder includes a housing adapted to be inserted into a cylinder head. A rod is slidably engaged in the housing and is adapted to move between a first position and a second position. A biasing element, which may be located inside or outside of the housing biases the rod into the first position.

15 Claims, 9 Drawing Sheets

(56) References Cited

FOREIGN PATENT DOCUMENTS

| | | | | |
|---|---|---|---|---|
| FR | 2 377 021 | | 8/1978 | |
| FR | 2377021 | * | 8/1978 | ..... F15B 15/2807 |
| GB | 2 410 129 A | | 7/2005 | |

OTHER PUBLICATIONS

International Search Report and Written Opinion for PCT/US2012/065457 mailed Jun. 19, 2013.
Strokemaster brochure, Balluff, 4 pgs.
Admitted prior art, submitted with application filing, 2 pgs.

* cited by examiner

PROXIMITY SWITCH ACTUATION MECHANISM

CROSS-REFERENCE TO RELATED APPLICATIONS

This application claims priority to and the benefit of U.S. Provisional Patent Application Ser. No. 61/561,453, filed Nov. 18, 2011, entitled "Proximity Switch Actuation Mechanism," the disclosure of which is hereby incorporated by reference herein in its entirety.

INTRODUCTION

Hydraulic fluid cylinders, reciprocating cylinder pumps, and other types of cylinder-based mechanical fluid-moving devices or engines use proximity sensors (also referred to as proximity switches) to sense position of cylinder pistons to, among other functions, prevent contact between the piston and cylinder head, which could be damaging if done at a high speed. Due to the variability in cylinder size (e.g., different manufacturers utilize differently-sized cylinders depending on desired capacity or application), not all sensors or switches may be easily utilized with all cylinders.

As an example, a partial hydraulic system configuration is depicted in FIG. 1. The system 100 includes a cylinder head 102 and a cylinder 104 defined by a cylinder wall 104*a*. A piston 106 moves reciprocally within the cylinder 104 along a piston or cylinder axis A. One or more seals or bushings 108 prevent fluid flow from one side of the piston 106 to the other as the piston 106 moves within the cylinder 104. Dimensions of the cylinder head 102 may be measured by a diameter D or a depth d. Diameter D is the diameter of the cylinder head 102. Depth d, in one embodiment, is the distance from an outer surface 102*a* of the cylinder head 102 to the piston or cylinder axis A.

The system 100 also includes a proximity sensor 110 or switch that may include a base 112, one or more spacers 114, and a probe 116 located within an adaptor 118. In the depicted embodiment, the adaptor 118 projects out of the cylinder head 102, and spacer 114 is also used to ensure the proper penetration depth of the probe 116 into the cylinder head 102. In other embodiments, either or both of the adapter and spacer (or multiple spacers) may be utilized to ensure the proper probe penetration depth. The probe 116 extends through the cylinder head 102 in the direction of a piston rod 120 that is coaxial with the piston axis A. As the rod 120 moves, an enlarged element 122 (typically called a cushion, spud, or collar) on the rod 120 moves proximate the probe 116. All or part of the cushion 122 may be manufactured of a ferromagnetic material. The proximity of the ferromagnetic material 122 to the probe 116 is detected by the sensor 110, and further actions may be taken depending on the function of the sensor 110. In some embodiments, this may cause the sensor 110 to send a signal to a piston controller, causing a reverse movement of the piston 106. In other embodiments, an impact or potential impact signal may be delivered, either with an audible or visual warning. Other actions are known to a person of skill in the art.

The probe 116 may be characterized by a length l and a width w. The length l is dictated, at least in part, by the size of the cylinder head 102, as measured by the diameter D or the depth d. Larger heads 102 (with larger diameters D or depths d) require a longer probe length l. This is often not advantageous, as it requires additional parts to be kept in a machine shop or factory to address this disparity. Smaller cylinder head 102 sizes cause similar issues. For example, since probes 116 typically are not shortened to fit smaller cylinder heads 102, spacers 114 are used to decrease the length of the probe 116 located within the head 102. This may require additional spacer sizes to be kept in stock and matched as needed for a particular application. Similarly, adaptors 118 of different sizes/configurations may also be kept on hand to accommodate probe bores 102*b* of different dimensions, probes of different widths, etc.

As is clear from the above description, the variability in cylinder and probe sizes can cause a significant burden on factories, repair facilities, and other entities that build and service hydraulic and other cylinders. Cylinders of different configurations often require various spacers to accommodate a number of different supplier-purchased proximity switches. These configurations are often not interchangeable. As a result, additional part numbers for the cushion collars, cushion spuds, spacers and adapters are needed. Proximity sensors are offered in limited sizes for large bore cylinders due to the cost and different configurations that need to be assembled.

SUMMARY

What is needed, then, is a single sensor that can be used on a large variety of cylinders having different sizes, including large bore cylinders. In one aspect, the technology relates to an apparatus having: a cylinder wall defining a cylinder that extends along a central cylinder axis, the cylinder having an end; an end structure positioned at the end of the cylinder, the end structure having an inner surface that encloses the end of the cylinder, the end structure defining a first bore having an open end at the inner surface, the end structure also defining a second bore that intersects the first bore; a piston mounted within the cylinder, the piston being reciprocally movable along the central cylinder axis within the cylinder; a proximity sensor mounted to the end structure, the proximity sensor including a sensing probe positioned within the second bore of the end structure; an actuation cartridge mounted in the first bore, the actuation cartridge including: a housing having a first end and an opposite second end; a rod that mounts within the housing, the rod being reciprocally movable along an actuation axis that extends through the housing, the rod having first and second opposite ends, the rod being movable along the actuation axis between first and second positions, wherein when the rod is in the first position the first end of the rod projects a first distance past the inner surface into the cylinder and the second end of the rod is not sensed by the proximity sensor, wherein when the rod is in the second position the first end of the rod projects a second distance past the inner surface into the cylinder and the second end of the rod is sensed by the proximity sensor, and wherein the first distance is larger than the second distance; and a spring for biasing the rod toward the first position; and wherein when the piston approaches the end of the cylinder, the piston contacts the first end of the rod and moves the rod from the first position to the second position thereby causing the proximity sensor to detect the second end of the rod and thereby provide end-of-stoke sensing for the piston within the cylinder In another aspect, the technology relates to an actuation mechanism for an electromagnetic switch for a hydraulic cylinder, the mechanism including: a housing adapted to be inserted into a cylinder head; a rod slidably engaged in the housing, wherein the rod is adapted to move between a first position and a second position; and a biasing element for biasing the rod into the first position. In another aspect, the technology relates to a hydraulic cylinder system including: a cylinder defining a cylinder axis; a cylinder head; a proximity sensor including a probe located in a first bore defined by the cylinder head; and an actuation mechanism including a housing and a rod slidably located therein, wherein the actuation mechanism is located in a second bore defined by the cylinder head, and wherein the rod is positionable in a first position and a second position, wherein when in the first position, the rod extends at least partially into the cylinder.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

The technology described below has application in hydraulic fluid cylinders, reciprocating cylinder pumps, and other types of cylinder-based mechanical fluid-moving devices or engines that use proximity sensors. Additionally, the technology may be used in valves or in pneumatic cylinders, where the working fluid is air or another gas, as opposed to hydraulic fluid. For clarity, however, the following embodiments will be described as hydraulic cylinders.

Figure 2A:
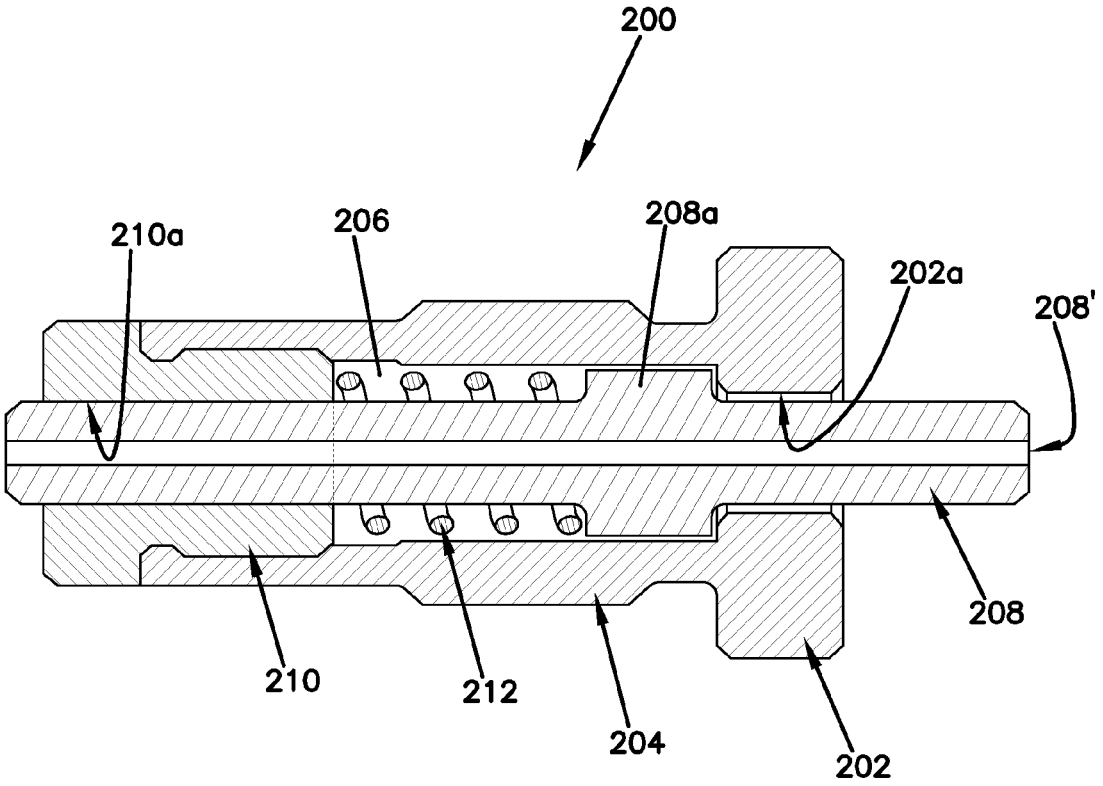
FIG. 2A is a sectional view of an actuation cartridge.
Figure 2B:
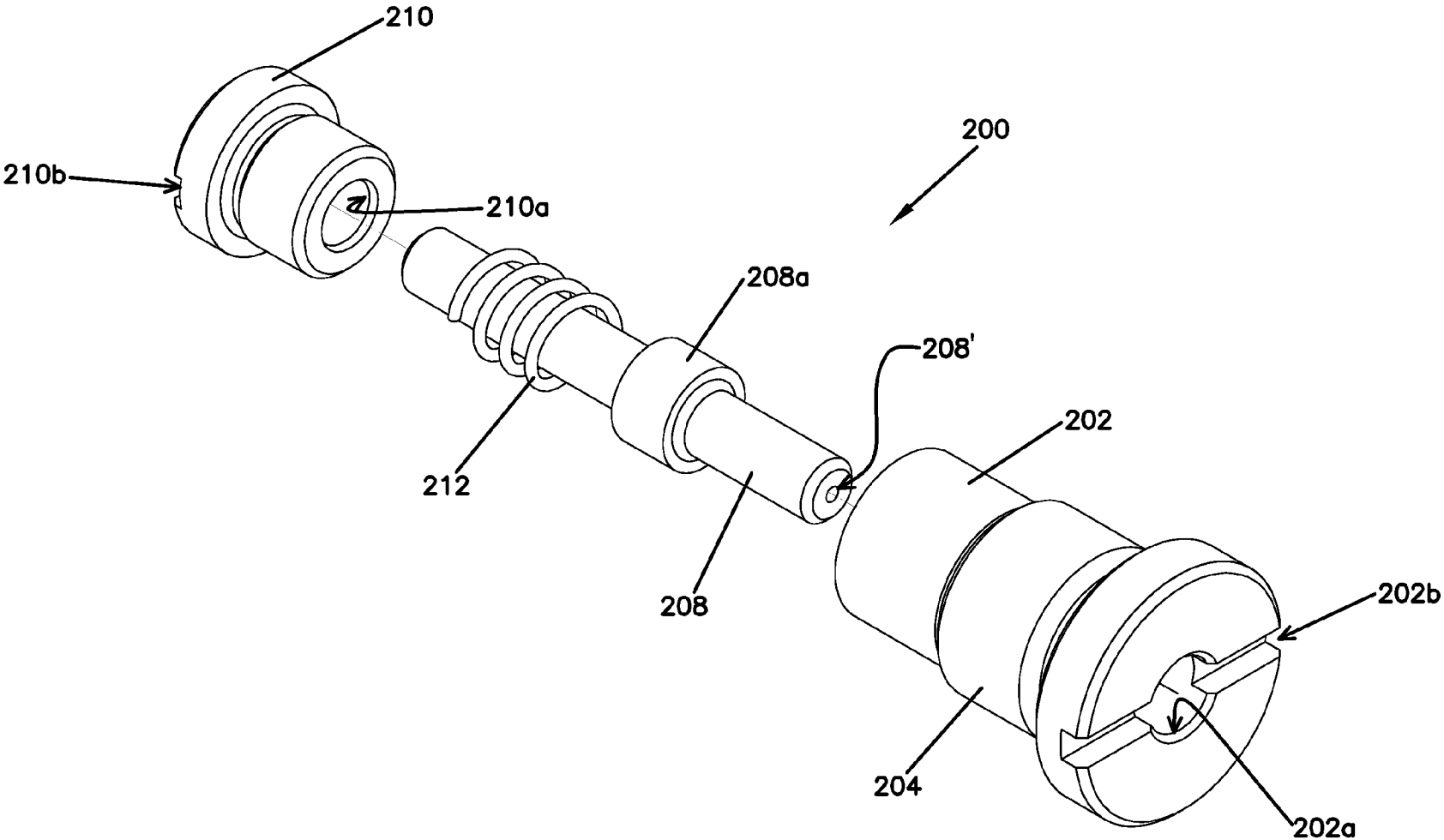
FIG. 2B is an exploded perspective view of the actuation cartridge of FIG. 2A.

FIGS. 2A and 2B depict sectional and exploded perspective views, respectively, of an actuation cartridge 200 or actuation mechanism. The cartridge 200 includes a housing 202 configured to fit within a bore in a cylinder head, as described in more detail below. In the depicted embodiment, the housing has an outer surface having a threaded portion 204 on at least a portion thereof. This threaded portion 204 is used to secure the cartridge 200 into corresponding threads in a bore located in the cylinder head. In one embodiment, the threads are size 750-16, though any suitable thread size may be used. The housing 202 defines a void 206 therein. The void 206 may be substantially cylindrical in shape or may define any other shape required or desired to accommodate an actuation rod 208 that is slidably engaged or reciprocally moveable within the housing 202. The rod 208 defines an elongate axial bore or through-hole 208' that serves as a pressure balance bore. This pressure balance bore 208' reduces or eliminates movement of the actuation rod 208 due to pressure. At least a portion of the housing defines a bore 202*a* for receipt of the actuation rod 208. A guide bushing 210 defining a guide bore 210*a* helps guide movement of the actuation rod 208 from a first position (depicted in FIG. 2) to a second position (when a rod collar 208*a* of the rod 208 is closer to the bushing 210). The bushing 210 may be connected to the housing 202 via a threaded connection, press-fit connection, chemical adhesive, or any combinations thereof.

A biasing element, such as a compression spring 212, biases the rod 208 into the first position, by exerting a force against both the bushing 210 and the actuation rod 208 (in the depicted embodiment, against the collar 208*a*). This biases the rod 208 away from the guide bushing 210. In alternative embodiments, other springs such as extension springs, leaf springs, or elastomer elements may be utilized, depending on the configuration of the housing 202, actuation rod 208, and bushing 210. All or part of the actuation rod 208 may be manufactured of a ferromagnetic or electromagnetic material, so as to be sensed when in proximity to a sensor probe, as described below. In another embodiment, the bushing 210 and the collar 208*a* may be magnetized elements having the same polarities, thus forcing those to elements away from each other. Both the housing 202 and the bushing 210 include a slot 202*b*, 210*b*. The slot 210*b* is configured to receive a screw driver so as to secure the bushing 210 to the housing 202. Similarly, the slot 202*b* is configured to receive a screw driver so as to secure the housing 202 to the cylinder head 302. Other configurations of actuation cartridges are described below.

FIGS. 3A-3D are partial sectional views of a hydraulic cylinder system 300 with a reciprocally movable piston 306 in various positions. The system 300 also includes a cylinder 304 defined by a cylinder wall 304*a* in which the piston 306 is slidably received. The piston is moved by a piston rod 320 located on a piston or cylinder axis A. A bushing 308 prevents movement of fluid from one side of the piston 306 to the other side. A cylinder head 302 has secured to an outer surface 302*a* thereof a proximity sensor 310. The cylinder head 302 includes a first bore 302*b* for receipt of a probe 316 from the sensor 310, as well as a second bore 302*c* or port from an inner surface of the cylinder head for receipt of the actuation cartridge 200. An O-ring or other sealing element 310*a* may be used to prevent fluid leaks from the interior of the cylinder 304 to the exterior thereof, via the bores 302*b*, 302*c*. The second bore 302*c* defines a bore axis C that is parallel, but need not be coaxial with, piston or cylinder axis A. In the depicted embodiment, bore axis C is coaxial with an axis upon which the actuation rod 208 reciprocates. The cartridge housing 202 may be threadably engaged with a corresponding threaded inner surface of the bore 302*c*. In alternative embodiments, the cartridge 200 may be secured within the bore 302*c* with a press-fit connection, chemical adhesive, or any combination of securing elements. As described above with regard to FIG. 2, the cartridge 200 includes a housing 202, an actuation rod 208, a biasing element 212, and a bushing 210.

Figure 3A:
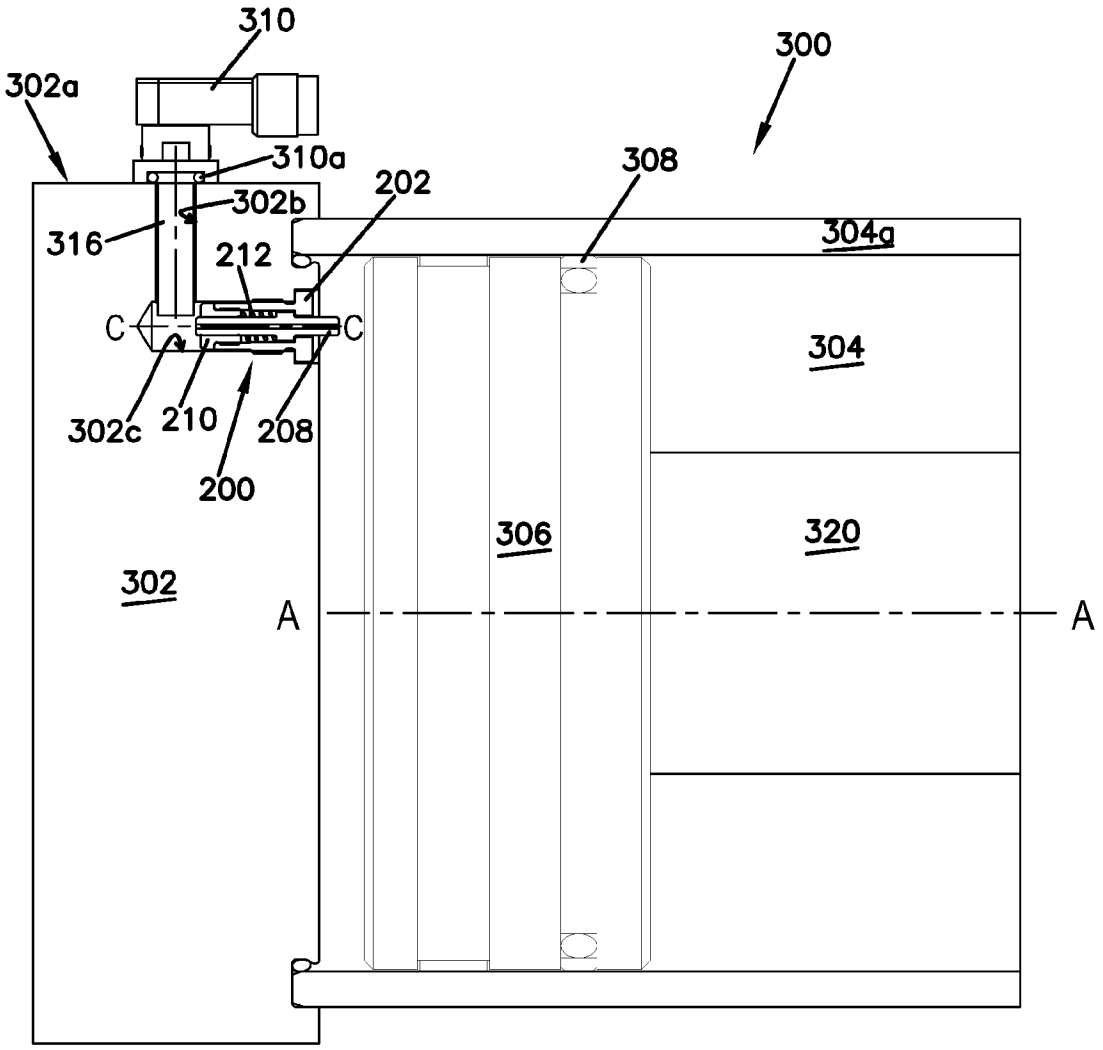
FIG. 3A is a partial sectional view of a cylinder system with a piston in a first position.
Figure 3B:
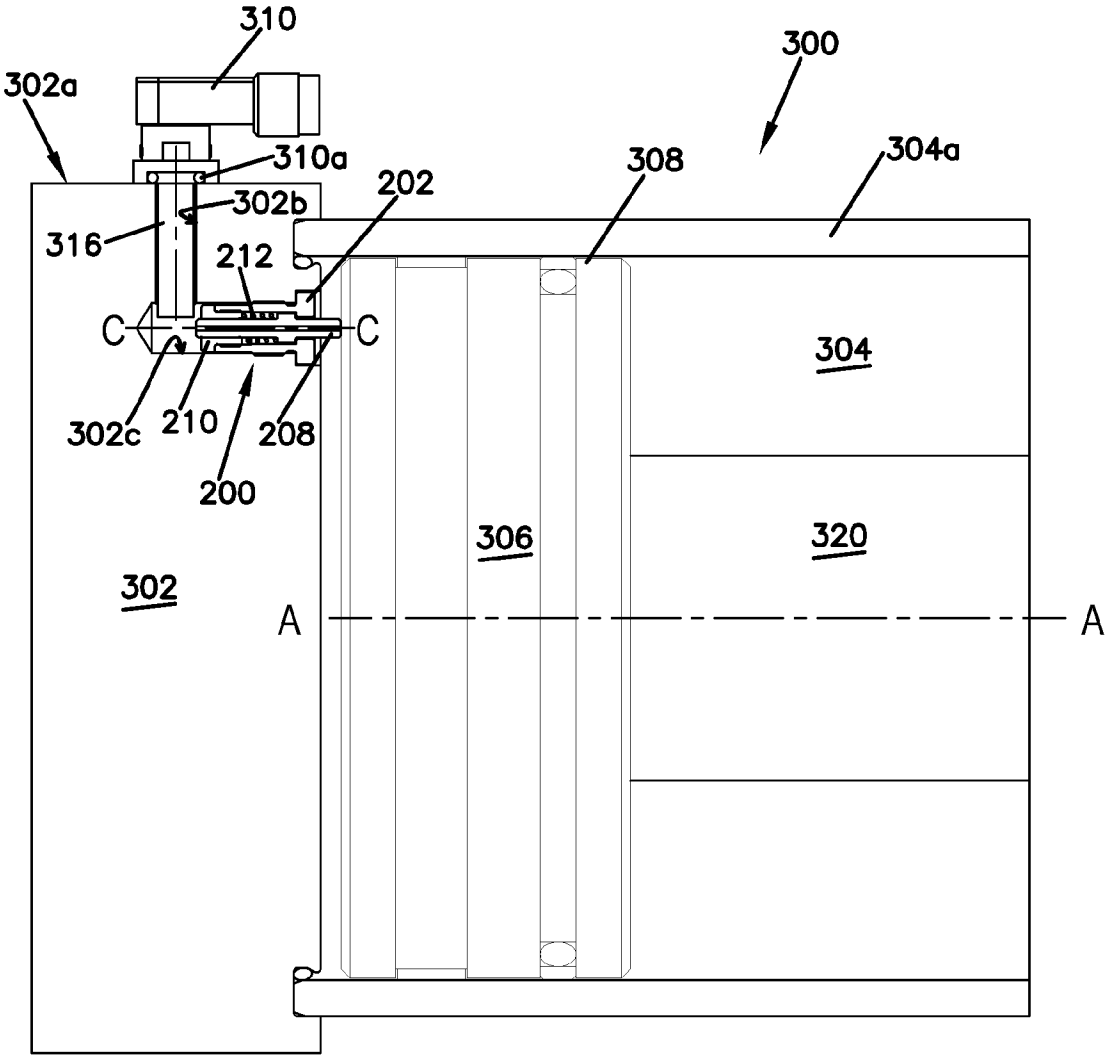
FIG. 3B is a partial sectional view of the cylinder system of FIG. 3A with the piston in a second position.
Figure 3C:
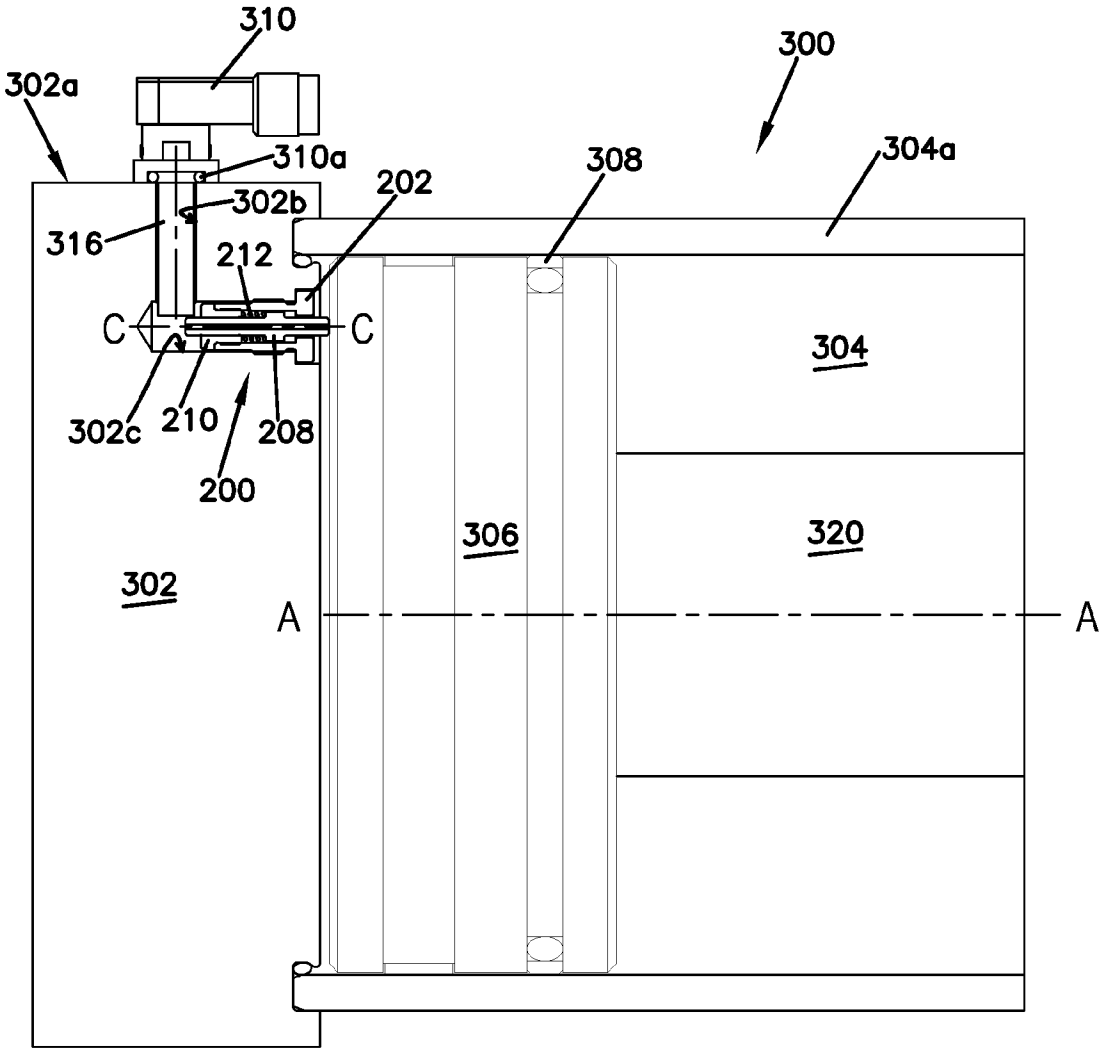
FIG. 3C is a partial sectional view of the cylinder system of FIG. 3A with the piston in a third position.
Figure 3D:
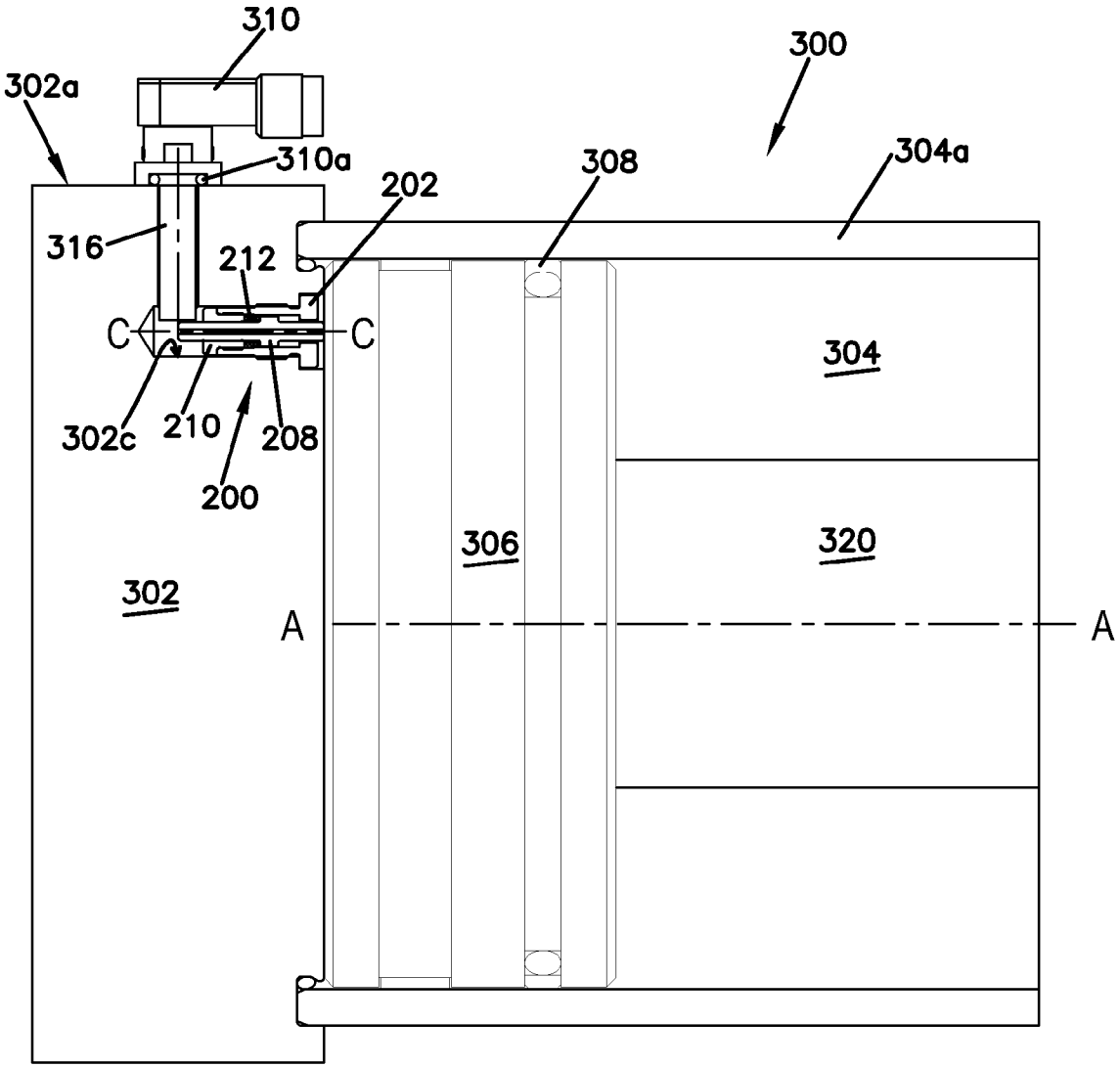
FIG. 3D is a partial sectional view of the cylinder system of FIG. 3A with the piston in a fourth position.

FIGS. 3A-3D depict the cylinder system 300 with the piston 306, as well as the actuation rod 208 in various positions. FIG. 3A depicts the piston 306 in a first position, not in contact with the actuation rod 208. In this position, the piston 306 may be moving toward or away from the actuation rod 208. Also, in this first piston position, actuation rod 208 is biased by the spring 212 away from the probe 316. Accordingly, presence of the actuation rod 208 is not sensed by the sensor 310. FIG. 3B depicts the piston 306 in a second position, in contact with an end of the actuation rod 208. In this position, movement of the actuation rod 208 has not yet occurred, thus proximity of the actuation rod 208 to the probe 316 is not yet detected by the sensor 310. FIG. 3C depicts the piston 306 in a third position, moving the actuation rod 208 to the left of the figure. As the actuation rod 208 moves further into the housing 202, the spring 212 compresses. In general, the spring force is insufficient to overcome the force exerted by the piston 306. In this position, the proximity of the actuation rod 208 to the probe 316 may not be sensed, depending on the sensitivity of the sensor 310, length of the rod 208, or other factors. In other embodiments, the sensor 310 may send a signal to a controller based on the presence of the rod 208. These signals may correspond to actions such as STOP, REVERSE, WARNING, or other signals known to those of skill in the art. For example, the signals may be used to control or adjust a sequence of operation for the cylinder, either alone or in a system of cylinders that perform a particular function. In a more specific example, a first cylinder may actuate to clamp a workpiece. Once the workpiece is clamped (as indicated by the signal sent from the sensor) a second cylinder may move a machining tool into position. FIG. 3D depicts the piston 306 in a fourth position, where the piston 306 contacts the cylinder head 302 and the spring 212 is fully compressed. As with the position of the rod 208 in FIG. 3C, this position may cause the sensor 310 to detect the presence or proximity of the rod 208, via the probe 316. Alternatively, this position may cause the sensor 310 to send a different signal to a controller, e.g., WARNING, IMPACT, etc., as required for the particular application. In other embodiments, this fourth position may not be reached by the piston 306, since the sensor 310 may send a signal to reverse movement of the piston 306 upon reaching the third position depicted in FIG. 3C.

Notably, the bore 302*c* that receives the actuation cartridge 200 is located proximate the outer portion of the cylinder head 302, and intersects bore 302*b*. This is in contrast to the configuration depicted in FIG. 1, where the bore through which the probe 116 passes intersects the bore through which piston rod 120 passes. In the case of the system 300 depicted in FIGS. 3A-3D (as well as FIGS. 4B and 5B), bore 302*b* need only extend into the cylinder head 302 a minimum distance. In FIGS. 3A-3D, the piston axis A is a significant distance from bore 302*b*. In that regard, it is clear that the configuration of the system 300 depicted in FIGS. 3A-3D is very advantageous for large bore cylinders.

Figure 4A:
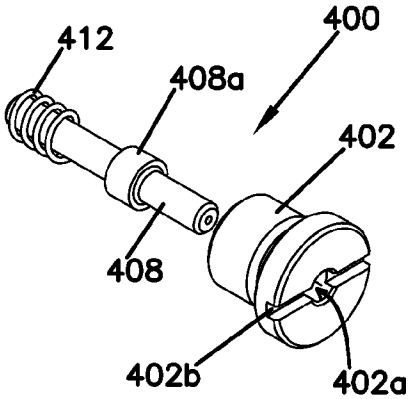
FIG. 4A is an exploded perspective view of another embodiment of an actuation cartridge.
Figure 4B:
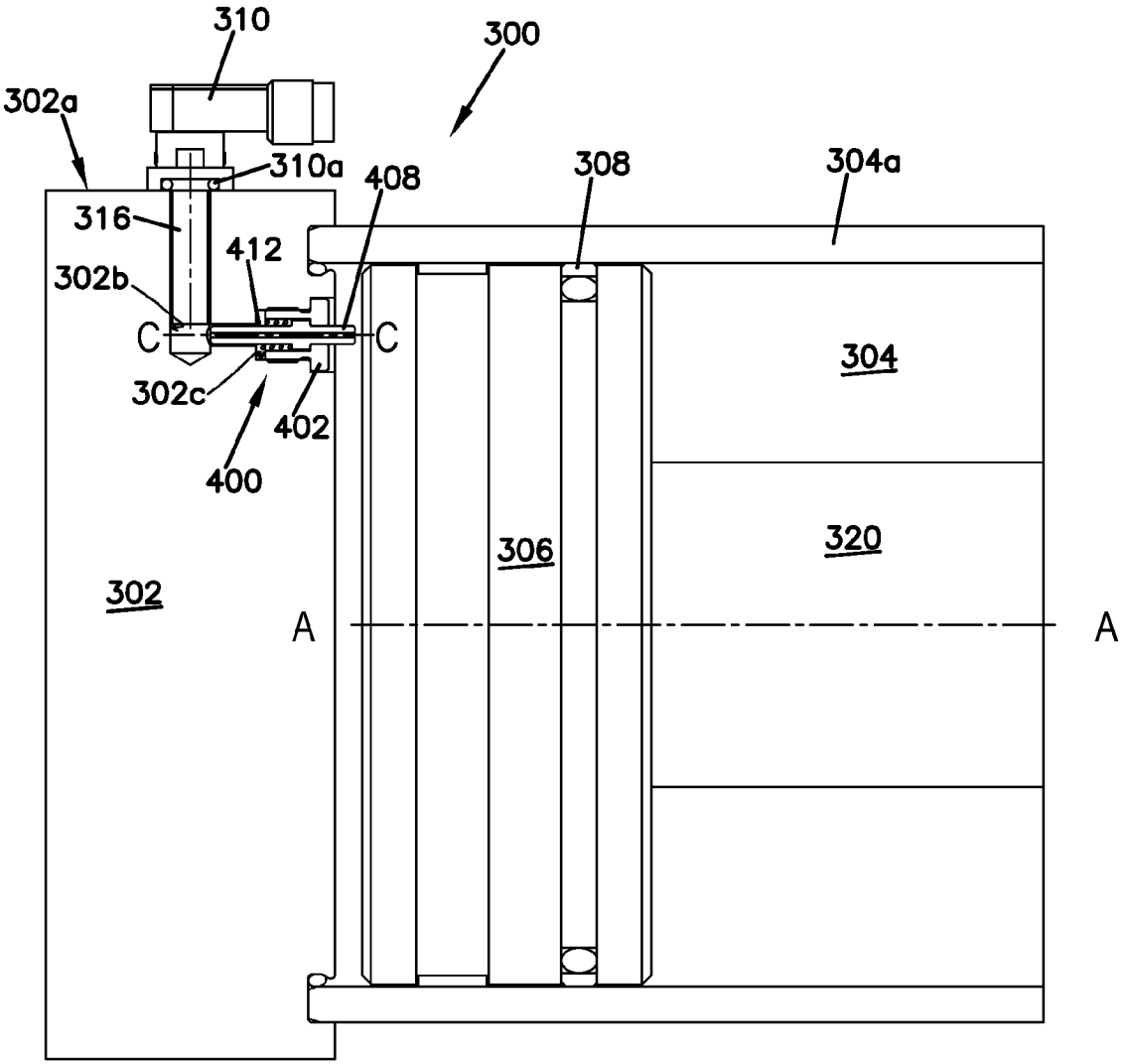
FIG. 4B is a partial sectional view of a cylinder system including the actuation cartridge of FIG. 4A.

FIG. 4A depicts another embodiment of an actuation cartridge 400. This cartridge 400 also includes a housing 402 defining a central bore 402*a* and a slot 402*b*. An actuation rod 408 passes through the bore 402*a* and includes a collar 408 that may be biased by a spring element 412. This cartridge 400 is depicted installed in a cylinder system 300 in FIG. 4B. A number of the elements identified in FIG. 4B are described with regard to FIGS. 3A-3D and are therefore not described further. In the depicted embodiment, the spring 412 exerts a force directly against an interior portion of the probe bore 302*b*, which is differently configured than the cartridge bores 302*c* depicted in the previous figures. Additionally, in this embodiment, the cartridge bore 302*c* is configured to directly receive the actuation rod 408 proximate the probe bore 302*b*. This differently dimensioned cartridge bore 302*c* still intersects probe bore 302*b*, allowing the rod 408 to move proximate the probe 314 to be detected.

Figure 5A:
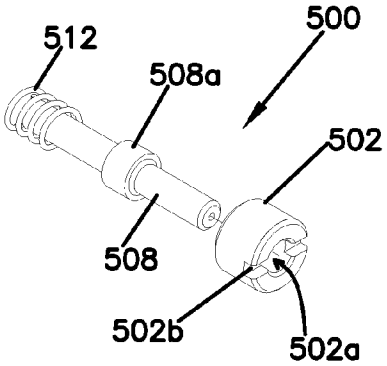
FIG. 5A is an exploded perspective view of another embodiment of an actuation cartridge.
Figure 5B:
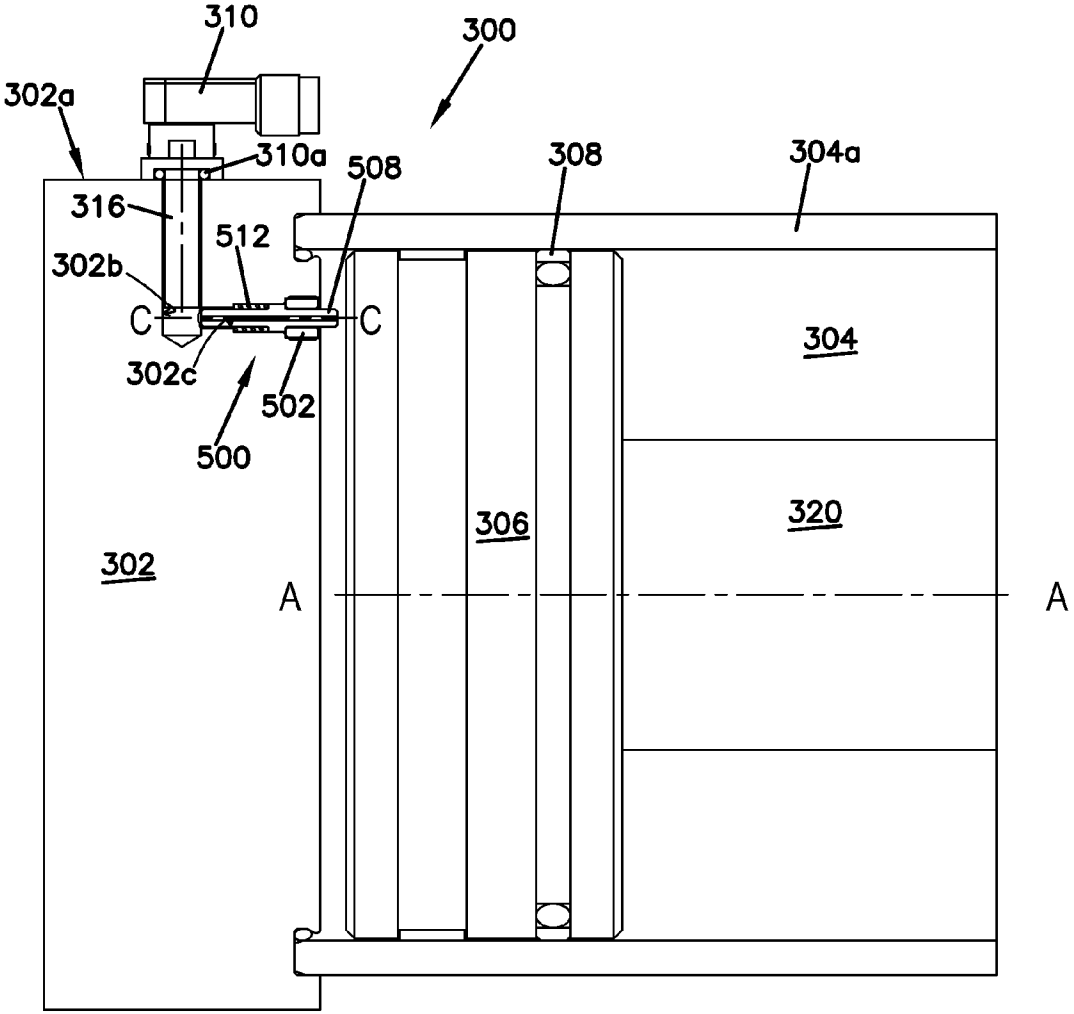
FIG. 5B is a partial sectional view of a cylinder system including the actuation cartridge of FIG. 5A.

FIG. 5A depicts yet another embodiment of an actuation cartridge 500. This cartridge 500 also includes a housing 502 defining a central bore 502*a* and a slot 502*b*. An actuation rod 508 passes through the bore 502*a* and includes a collar 508*a* that may be biased by a spring element 512. This cartridge 500 is depicted installed in a cylinder system 300 in FIG. 5B. A number of the elements identified in FIG. 5B are described with regard to FIGS. 3A-3D and are therefore not described further. In the depicted embodiment, the spring 512 exerts a force directly against an interior portion of the probe bore 302*b*, which is differently configured than the probe bore 302*b* depicted in FIGS. 3A-3D and 4B. Additionally, the spring 512 may contact the internal surface of the cartridge bore 302*c*. This differently dimensioned cartridge bore 302*c* still intersects probe bore 302*b*, allowing the rod 508 to move proximate the probe 316 to be detected.

Figure 1:
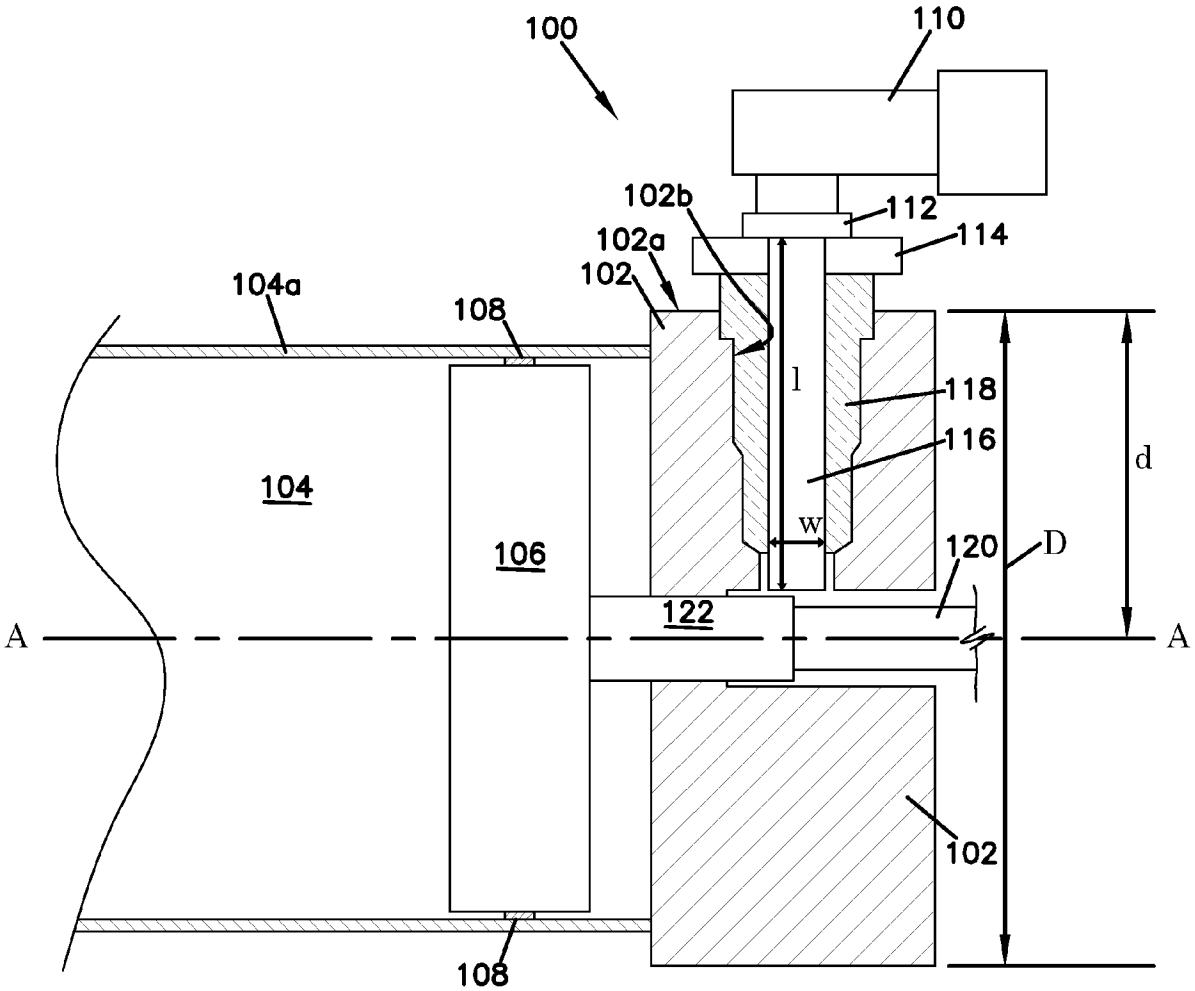
FIG. 1 (Prior Art)
FIG. 1 is a partial sectional view of a prior art hydraulic cylinder.

It should be noted that the probe bores 302*b* depicted in FIGS. 3A-3D, 4A, and 5A are similarly dimensioned, thus obviating the need for the adaptor 118 depicted in FIG. 1. Since the same length probe may be used in the embodiments depicted herein, a consistently dimensioned bore 302*b* may be made in any cylinder head in which the described technology is used. Thus, the actuation cartridges described herein allow standard sensors and probes to be used regardless of the configuration of the actuation cartridge, thus eliminating the need for customized probe bores.

The materials used for the devices described herein may be the same as those typically used for hydraulic cylinders or other similar applications. These include metals such as steel, stainless steel, titanium, bronze, cast iron, and platinum, as well as robust plastics or fiber-reinforced plastics.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An apparatus comprising:

a) a cylinder wall defining a cylinder that extends along a central cylinder axis, the cylinder having an end;

b) an end structure positioned at the end of the cylinder, the end structure having an inner surface that encloses the end of the cylinder, the end structure defining a first bore having an open end at the inner surface, the end structure also defining a second bore that intersects the first bore;

c) a piston mounted within the cylinder, the piston being reciprocally movable along the central cylinder axis within the cylinder;

d) a proximity sensor mounted to the end structure, the proximity sensor including a sensing probe positioned within the second bore of the end structure;

e) an actuation cartridge mounted in the first bore, the actuation cartridge including:

a housing having a first end and an opposite second end, wherein the first end is disposed at the open end of the first bore at the inner surface;

a rod that mounts within the housing, the rod being reciprocally movable along an actuation axis that extends through the housing, the rod having first and second opposite ends, the rod being movable along the actuation axis between first and second positions, wherein when the rod is in the first position the first end of the rod projects a first distance past the inner surface into the cylinder and the second end of the rod is not sensed by the proximity sensor, wherein when the rod is in the second position the first end of the rod projects a second distance past the inner surface into the cylinder and the second end of the rod is sensed by the proximity sensor, and wherein the first distance is larger than the second distance, and wherein when the rod is in the first position the first end extends from the housing, and wherein when the rod is in the second position the second end extends from the housing; and a spring for biasing the rod toward the first position; and f) wherein when the piston approaches the end of the cylinder, the piston contacts the first end of the rod and moves the rod from the first position to the second position thereby causing the proximity sensor to detect the second end of the rod and thereby provide end-of-stroke sensing for the piston within the cylinder.

2. The apparatus of claim 1, wherein an axial through-hole is defined through the rod.

3. The apparatus of claim 1, wherein the housing is threaded within the first bore.

4. The apparatus of claim 1, wherein at least the second end of the rod includes an electromagnetic property that is sensed by the proximity sensor.

5. The apparatus of claim 1, wherein the first bore defines a bore axis that is offset from the central cylinder axis.

6. The apparatus of claim 5, wherein the bore axis, the actuation axis and the central cylinder axis are all parallel.

7. A hydraulic cylinder system comprising:

a cylinder defining a cylinder axis;

a cylinder head;

a proximity sensor comprising a probe located in a first bore defined by the cylinder head;

an actuation mechanism comprising a housing defining a slot facing an interior of the cylinder and a rod slidably located in the housing, wherein the actuation mechanism is located in a second bore defined by the cylinder head, and wherein the rod is positionable in a first position and a second position, wherein when in the first position, the rod extends at least partially into the cylinder; and a biasing element disposed between and in contact with the second bore of the cylinder head and the rod, wherein the biasing element biases the rod into the first position.

8. The hydraulic cylinder system of claim 7, wherein when in the second position, the rod is located proximate the probe.

9. The hydraulic cylinder system of claim 8, wherein the sensor detects a presence of the rod when the rod is in the second position.

10. The hydraulic cylinder system of claim 7, further comprising a piston.

11. The hydraulic cylinder system of claim 10, wherein a force exerted by the piston forces the rod into the second position.

12. The hydraulic cylinder system of claim 7, wherein the housing comprises a threaded surface.

13. The hydraulic cylinder system of claim 7, wherein the second bore defines a bore axis, wherein the bore axis is parallel to the cylinder axis.

14. The hydraulic cylinder system of claim 13, wherein the bore axis is not coaxial with the cylinder axis.

15. The hydraulic cylinder system of claim 7, wherein the rod comprises a first end and a second end disposed opposite the first end, and wherein when in the first position the first end extends from the housing, and wherein when in the second position the second end extends from the housing.

* * * * *